United States Patent [19]

Zayauskas

[11] Patent Number: 4,535,753

[45] Date of Patent: Aug. 20, 1985

[54] RADIANT HEAT COLLECTOR

[76] Inventor: Leo Zayauskas, 9327 S. Hamilton Ave., Chicago, Ill. 60620

[21] Appl. No.: 599,516

[22] Filed: Apr. 12, 1984

[51] Int. Cl.[3] ..... A21B 1/00

[52] U.S. Cl. ..... 126/274; 126/9 R

[58] Field of Search ..... 126/9 R, 29, 30, 274, 126/275 R, 438, 451, 9 B; 350/293, 294, 299

[56] References Cited

U.S. PATENT DOCUMENTS

| | | | |
|---|---|---|---|
| 6334 | 1/1831 | Willision | 126/274 |
| 6774 | 9/1831 | Willcox | 126/274 |
| 132,167 | 10/1872 | Marshall et al. | 126/274 |
| 427,799 | 5/1890 | Ryer | 126/274 |
| 868,465 | 10/1907 | Mauk | 126/274 |
| 2,580,925 | 5/1947 | Jarvis | 126/9 R X |
| 2,921,577 | 1/1960 | Smith | 126/274 |
| 2,969,055 | 1/1961 | Martin | 126/9 R X |
| 2,994,318 | 8/1961 | Lee | 126/451 X |
| 3,026,866 | 3/1962 | Lynch | 126/274 |
| 3,712,285 | 1/1973 | Copeland | 126/9 R |

FOREIGN PATENT DOCUMENTS

| | | | |
|---|---|---|---|
| 1137371 | 12/1982 | Canada | 126/438 |

*Primary Examiner*—Margaret A. Focarino

*Attorney, Agent, or Firm*—Richard G. Kinney

[57] ABSTRACT

A radiant heat collector is disclosed in the form of a reflector oven. The oven collects heat from a heat source adjacent to the oven. The reflective surfaces are detachably secured to end plates, which plates are of a generally rectangular configuration. Tie rods may be used to retain the grill assembly, or tabs on either the grill or on the reflective surfaces, or on both, and may be used for this purpose with or without tie rods. The assembled reflector is of a generally elliptical section shape (rather than parabolic) to enhance the thorough heating of the material placed on the grill to be heated. The elliptical section encompasses one end of an ellipse about one focus line and a source of heat may be conveniently located at the other focus line. The major axis of the ellipse dips downward from the section to the heat source and the rack or grill is positioned under the section focus line esssentially to one side of the major axis. The source of heat for the grill is generally an external source, such as a fire, positioned in front of and fairly close to the oven at the elliptical external focus line. The oven is readily assembled or disassembled to form a compact package and may be used indoors with a fireplace, for example, or outdoors when camping or picnicking.

16 Claims, 7 Drawing Figures

RADIANT HEAT COLLECTOR

BACKGROUND OF THE INVENTION

1. Field of the Invention

The field of the invention relates to radiant heat collectors generally and specifically to ovens and to oven supports for grills for cooking materials from a source of heat preferably disposed slightly in front of the oven, such as a campfire or an indoor log fire.

2. Description of the Prior Art

A number of previous attempts have been made and some patented wherein a cooking oven was provided for supporting a grill on which food was to be cooked and wherein the source of heat was in front of the grill and the heat therefrom was reflected into the oven and onto the food on the grill to be cooked.

One very early patent relating to a domestic oven is Williston, U.S. Pat. No. 6,334 issued Jan. 11, 1831. The Williston patent discloses a portable domestic oven which is open at the front and has inclined reflecting surfaces with a grill supported therebetween on which the food to be cooked is placed. The Williston patent merely shows the general idea of having an oven which will support a grill for food to be cooked and which has a generally circular inclined top above the grill.

U.S. Pat. No. 6,774 to Willcox, issued on Sept. 28, 1831, shows a domestic oven similar to the Williston patent issued Jan. 11, 1831.

Another patent to Marshall et al. U.S. Pat. No. 132,167 for Broiler, issued Oct. 15, 1872, shows a similarly rounded inclined top for an oven or broiler of the type involved which contains a grill for supporting the food to be cooked. It is provided with adjustable feet to regulate the inclination and height of the reflectors.

Ryer U.S. Pat. No. 427,799, issued May 13, 1890, for "Oven Attachment for Drums" discloses a cooking oven which may be attached to a drum which is heated. The attachment providing the oven is circular at its front to conform to the round heat pipe and is generally oval in its configuration which supports the cooking grill. It provides a damper for regulating the amount of heat which is applied to the material to be cooked. However, it does not illustrate a complete oven for use with, for example, a horizontally disposed heat source, such as an open fire in front thereof, nor one which is formed of few readily attachable and detachable metal plates which form an elliptical oven for supporting a grill.

Mauck U.S. Pat. No. 868,465, issued Oct. 15, 1907, discloses a Combined Bucket and Cooker and is merely of general interest with respect to applicant's invention.

Lee U.S. Pat. No. 2,994,318 for a Solar Portable Stove and Pressure Cooker, issued Aug. 1, 1961, provides an oven in which solar heat is utilized to cook the food and shows a generally half circular reflector for the heat.

Lynch U.S. Pat. No. 3,026,866, issued Mar. 27, 1962 for Collapsible Reflector Oven discloses a reflector oven which is collapsible for carrying into a substantially flat configuration and has a partially circular reflector for heat. This includes lower vertical attachment portions and an upper inclined portion forming supports for a sheet of reflective metal which is arched between the opposite ends of the frames. It does not describe any particular shape for the metal foil reflector which is removable.

SUMMARY OF THE INVENTION

A radiant heat collector serves to set collect heat from an elongated heat source and distributing it to a load and constructed in accordance with the principles of the present invention comprises means for defining an elliptical segment concave surface. That surface is approximately that developed by a straight line generatrix and a directrix that is a portion of an ellipse and is formed to reflect radiant heat. Also provided are means for positioning that surface so that the elongated heat source is located along one focus line of the surface and means for holding the load at its other focus line. This allows radiant heat from the source to be reflected by the surface and concentrated at the other line and distributed to the load.

The invention is for a reflective oven holder for a grill to reflect from a heat source adjacent to the grill wherein the reflective surface and the supports therefore are readily attachable or detachable and provide an elliptical reflecting surface between the source of heat and the material to be cooked. Several constructions are shown for assembling and disassembling the reflective oven, all of which are inexpensive sheet metal parts which may be formed or bent with ease.

One advantage is to reduce the weight and manufacturing costs of such a grill support and eliminate small detachable parts, preferably, such as wing nuts which may be lost. An alternative reflective surface is comprised of three sections. The two long, transverse sides of each section would be doubled over and at an angle (approximately 45° ) to the center section. Tabs are formed by bending the side extensions. To assemble, each section would be bent and the tabs placed through perforations in the side sections and released. The tendency to return to a flat shape will maintain the assembly in position.

The alternative grill is intended to replace the strips employed in the original version. In this construction, the hooked ends of the grill pass through perforations, or openings, in the side sections and slide down, adding to the locking action of the reflector section tabs.

More broadly, the present invention is applicable to many environments of use wherein a generally longitudinal heat source exists and it is desired to gather and concentrate the radium heat therefrom into a spaced apart generally longitudinal area.

The invention, together with the advantages thereof, may best be understood by reference to the following description taken in connection with the accompanying drawings, in the several figures of which like-reference numerals identify like-elements.

DESCRIPTION OF THE PREFERRED EMBODIMENTS

Figure 4:
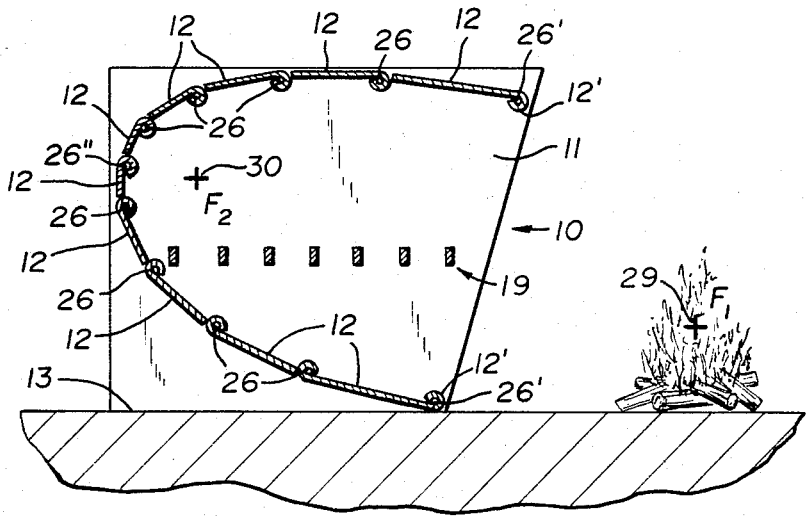
FIG. 4 is a sectional view taken on line 4—4 of FIG. 3.

The first embodiment of the invention is illustrated in FIGS. 1 through 4 and comprises an oven generally indicated by the numeral 10. The oven 10 is preferably portable and comprises a pair of generally rectangular end plates 11 provided with flat bottom edges 13, although the configuration of the end plates, other than the flat bottoms, is a matter of choice. The oven 10 is provided with a plurality of reflective plates 12 which preferably have at least their inner surface provided with reflective coatings. The plates 12 are preferably made of aluminum with polished interior surface. Preferably, there are ten such reflective plates 12 hinged together edge to edge by having alternative sections of these longitudinal edges turned over to encompass hinge rods 26. The outer or end top and bottom plates 12 have these extreme longitudinal edges 12′ turned over rods 26′ (FIG. 4). All of the rods 26, 26′ extend slightly through the end plates 11 through holes sized to receive them. Several of these, preferably the end rods 26′ and a central rod 26″, are provided with threads on which wing nuts 28 are attached to maintain the assembly in position. The rods 26 extending through the end plates also assist in imparting structural stability to the oven.

The reflectors walls 12 form an elliptical section concave cylindrical surface, as better seen in FIG. 4; that is, a surface generated by an elliptical section as a directrix and a perpendicular straight line as a generatrix. See, for example, Dynamic Solid Geometry by Skolnik, et al., Van Nostrand, Princeton, N.J. (1959), Library of Congress Catalog Card No. 52-6384 at page 84.

The full ellipse cylinder would have two focus lines $F_1$ (29 in FIG. 3) and $F_2$. As can be seen from FIG. 3, the surface formed by the reflectors 12 is approximately half of the ellipse about the focus $F_2$.

Figure 1:
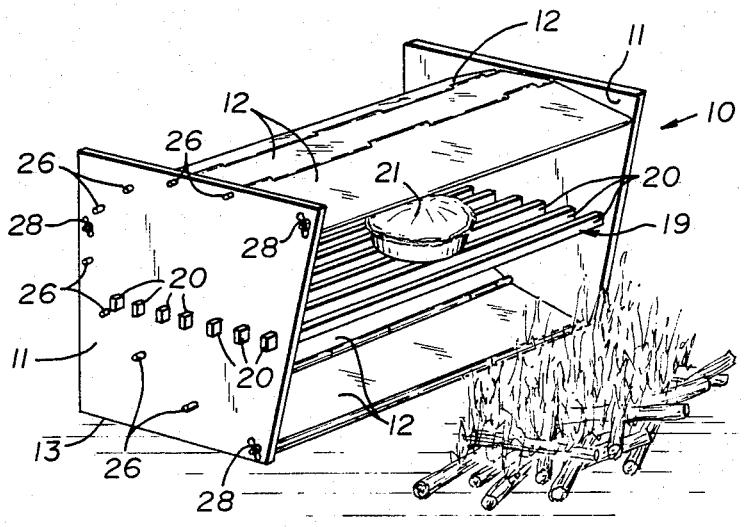
FIG. 1 is a perspective view of the front side of the grill with a fire disposed closely to and adjacent to the grill.
Figure 2:
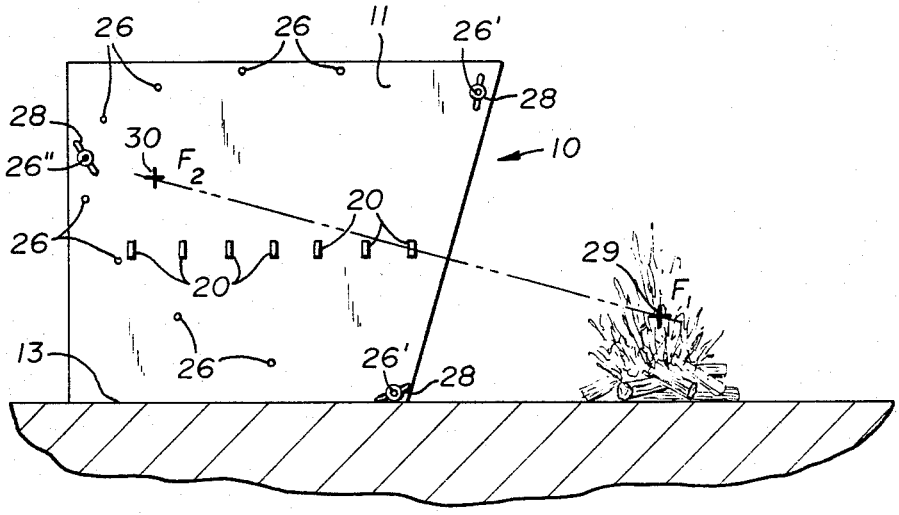
FIG. 2 is an end view of the device shown in FIG. 1 with a dot-and-dash line showing the path of the heat from the fire to the interior of the oven and across the grill.
Figure 3:
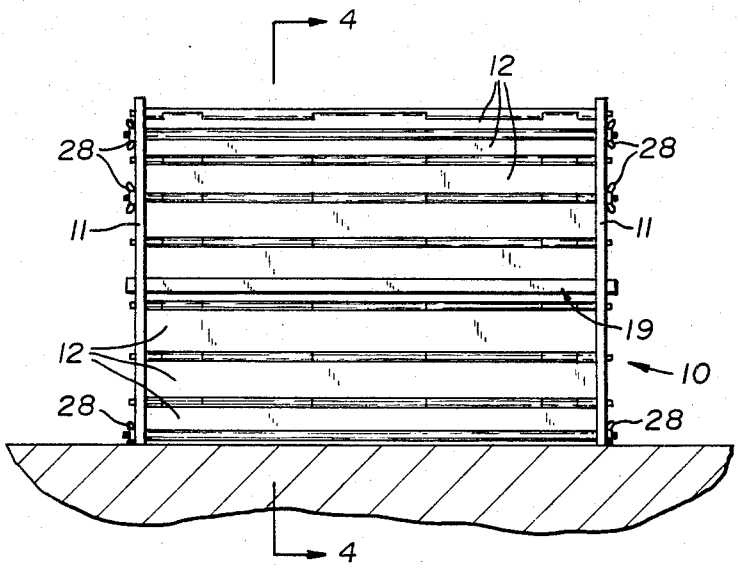
FIG. 3 is a front view of the oven shown in FIG. 1.

Thus, the oven 10 walls 12 define a segment of an ellipse whose focuses are the lines indicated at 29 and 30 in FIGS. 2 and 4. The fire is preferably made to be elongated along the line 29 so that the radiant heat therefrom tends to be reflected by the walls 12 to and through the focus 30. That is, the major axis of the ellipsoid is at an angle of downward to the fire and this rack lies approximately horizontal to one side thereof.

Of course, a good part of the radiant heat reflected by the lower segments 12 as intercepted by the rack 19 and food 21 lies across its path. That which passes through the focus is reflected back toward the focus 29 and, again, a good part of this is intercepted. Thus, the majority of the heat reflected by the bottom reflector 12 is intercepted by the rack 19 and food 21.

The heat reaching the upper reflectors 12 from the area of the fire passes through the focus line 30 and fans out therefrom to the rack 19′ and food 21 on it.

Of course, this is an idealized way analyzing the effect. As the area of heat emission from the fire is more diverse, so is, naturally, the oven to which the food is concentrated by the reflector. But the use of an elliptical reflector has the effect of capturing and using more effectively the radiant heat of the fire than would the common parabolic reflector.

Figure 5:
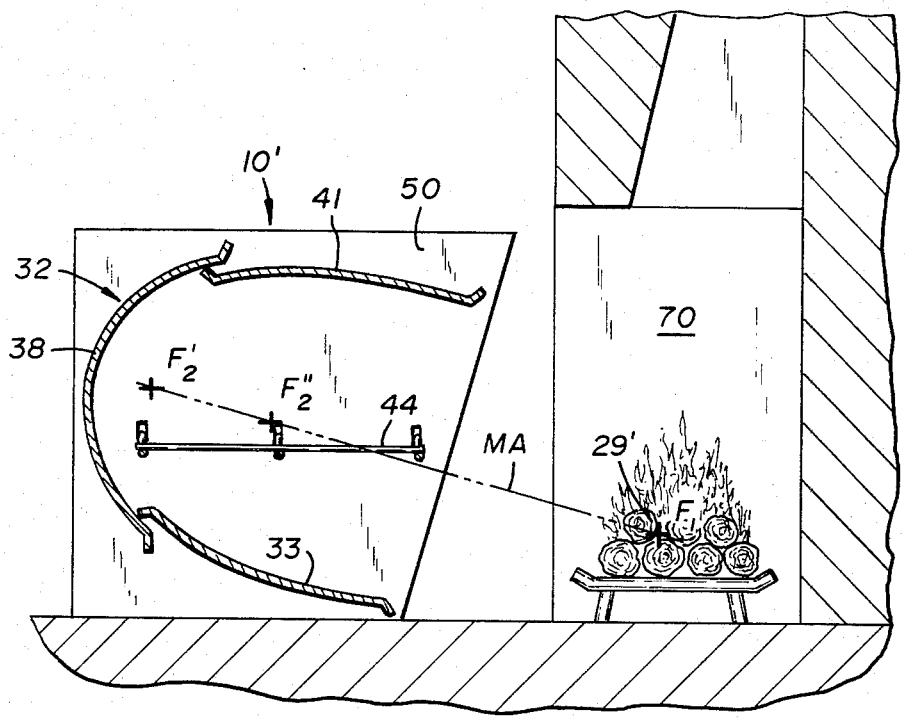
FIG. 5 is a vertical sectional view of a second embodiment of the invention showing a different configuration of the reflecting plates and grill and showing this embodiment in use at a fireplace.
Figure 6:
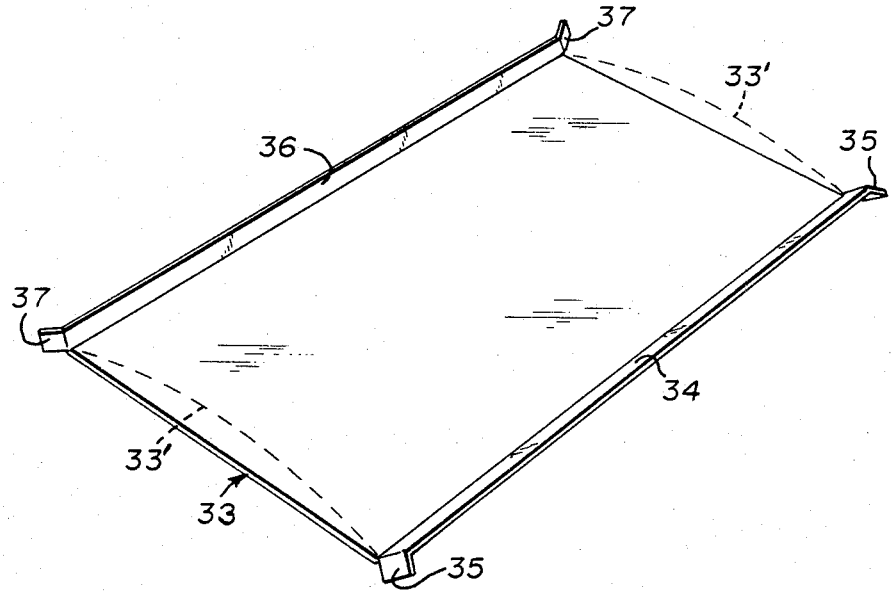
FIG. 6 is a perspective view of the reflector sections shown in FIG. 5.
Figure 7:
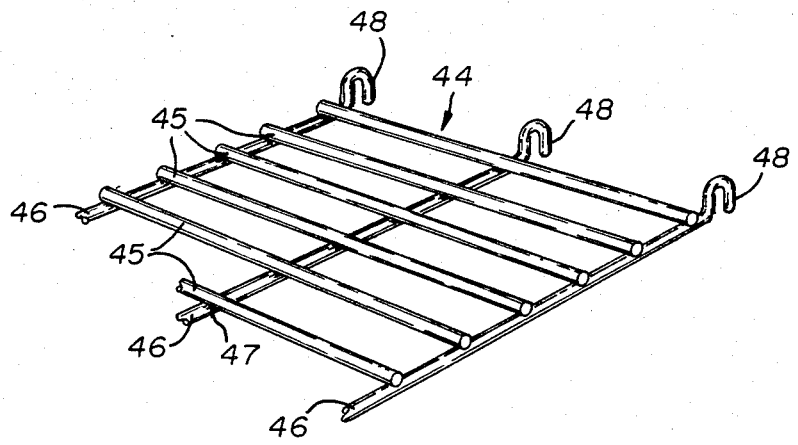
FIG. 7 is a partial view of the alternate grill end utilized in the construction shown in FIG. 5.

Referring now to FIGS. 5, 6 and 7 for a description of the second embodiment, it is noted that the oven is quite similar to the configuration of the embodiment shown in FIGS. 1 through 4. This second embodiment 10′ is shown in use before a fireplace 70. In the second embodiment 10′, the vertical end plates 50 are preferably constructed in a manner similar to the end plates 11 in the first embodiment. The source of heat is depicted at 29′ ($F_1$), and the radiant heat is reflected toward the focus line inside the oven. The reflector assembly is generally shown by the numeral 32 and has its inner surfaces formed in a generally elliptical shape because of the manner in which they are assembled. The assembly 32 includes a bottom section 33, a back section 38, and a top section 41. The sections 33, 38 and 41 are substantially identical to each other and that shown in FIG. 6 wherein only the bottom reflector 33 is illustrated; the dotted lines 33′ showing the position which the reflector 33 assumes when assembled in order to provide the elliptical interior reflector for the oven. Each plate 33, 38 and 41 is provided with an upturned flange 34 at one edge and a similar upturned flange 36 at the other end. The flange 34 is provided with small, downwardly turned tabs 35 at its extremities and the flange 36 is likewise provided with similar tabs 37.

The various sections 33, 38 and 40 are bent to shape as shown in FIG. 5 and the ends of the flanges 34 have the tabs 35 and 37 extend through perforations formed in the end plates 50 which are so positioned as shown in FIG. 5 to cause each of the reflective plates to bend and form elliptical interior surfaces when the oven is assembled (FIG. 6).

Unlike the previous version, the reflectors 41 and 33 are sections of one ellipse having focuses $F_1$ and $F_2'$, while the reflector 38 is a section of another ellipse having focuses $F_1$ and $F_2''$. Both ellipses have a common major axis MA and both focuses $F_2'$ and $F_2''$ are above a grill 44 similar in function to the grill 19 of the prior embodiment.

The use of two focuses $F_2'$ and $F_2''$ serves to spread the heat more evenly at the grill 44. The grill 44 is positioned in the elliptical reflector in substantially the same position as the grill 19 positioned in the first embodiment. The grill 44 includes intersecting rods 45 and 46 which are jointed together preferably by welding at their points 47 of crossing. As best shown in FIG. 7, the ends of the longitudinally extending rods 46 are provided with hooks 48 which extend through perforations 46 in both the end plates 50 substantially centrally thereof, it being understood that the hooks are provided at both ends of the rods 46. After the grill is inserted and forced downwardly in the perforations, the entire assembly is locked in position.

The embodiment of the invention shown in FIGS. 5 through 7 have the advantages of ease of manufacture and assembly. Only five parts are involved, namely, two identical side walls, three identical reflectors, and one grill that helps hold the side walls together.

With respect to both embodiments of the invention, the assembly and disassembly of the units are simple and the parts from which the ovens are manufactured are easily and readily fabricated. Preferably, the ovens are portable, although they may be used in fireplaces in relatively fixed positions if so desired. It is also to be noted that the contour of the ovens is elliptical rather than parabolic and such a shape increases the efficiency of many flame source heating systems.

While shown and described in the environment of an oven which is one preferred application of the invention, it should be noted that the invention in its broader aspects can be employed in other applications. For example, it could be used in fast heat-rise hot water heaters or boilers with, e.g., a gas grill along line $F_1$ and a water-carrying pipe along $F_2$.

While two particular embodiments of the invention have been shown and described, it will be obvious to those skilled in the art that changes and modifications may be made without departing from the invention and, therefore, the aim in the appended claims is to cover all such changes and modifications as fall within the true spirit and scope of the invention.

For purposes of concretely disclosing a particular embodiment, but not for purposes of limiting the scope of this patent, the following specifics on the prototype depicted in FIGS. 1 through 4 are submitted:

Width: 24 inches;

Height: 18 inches;

Walls 11 are of approximately 1/64 inch aluminum;

Walls 12 are of approximately 1/64 inch aluminum;

Rods 26 are of 1/16 inch and ¼ inch round stock, 24 inches long, and of steel;

Grill 19 is formed of ½ inch ×1/16 inch rectangular stock, 24 inches long;

The major axis of the ellipse of this embodiment is formed of approximately 33 inches long with the distance between the focuses $F_1$ $F_2$ (29–30) approximately 27 inches;

The second embodiment is preferably of approximately the same overall size and made up of reflectors made of 16-gauge aluminum sheeting bent over at their longitudinal edges.

What is claimed is:

1. A radiant heat collector for collecting radiant heat from an elongated heat source, and distributing it to a load, comprising:

means for defining an elliptical segment concave cylindrical surface, which cylindrical surface is approximately that developed by a straight line generatrix and a directrix that is a portion of an ellipse, said surface being formed to reflect radiant heat;

means for positioning said developed cylindrical surface means in relation to the elongated heat source such that said heat source is located along one focus line of the elliptical segment cylindrical surface; and means for holding the load in proximity to the other focus line of the elliptical segment cylindrical surface;

whereby radiant heat generated by the source is reflected by said surface and concentrated at the other focus line and substantially distributed to the load.

2. The collector of claim 1 wherein said source of heat is a fire along a horizontal line and the load is horizontally disposed, with the other focus line at a higher elevation than that of the one focus line.

3. The collector of claim 2 wherein said means for holding the load is a horizontal grill positioned below the other focus line.

4. The collector of claim 3 wherein said cylindrical surface means defines two elliptical cylindrical surfaces which have one of their elliptical focuses at the heat source, but the other focus spaced apart above said grill, whereby the heat of the fire is more evenly spaced along the grill.

5. A radiant heat collector as defined in claim 1 serving as a reflector oven adapted to reflect heat from a heat source adjacent an open end thereof said ellipitcal segment cylindrical surface defining means comprising a pair of vertically spaced substantially flat end plates provided with a plurality of substantially corresponding perforations in each, which are in substantial horizontal alignment when the oven is assembled:

one set of said perforations being formed in both plates in a generally accurate configuration adjacent the top front portions of the plates;

a second set of perforations formed in a generally accurate configuration adjacent the top of rear portions of the end plates;

a third set of perforations formed in a generally accurate configuration adjacent the bottom front portions of the end plates;

a plurality of reflective plates extending between the end plates when the oven is assembled;

a plurality of said reflective plates bent to provide a substantially closed rear, bottom, and top of the oven leaving the front thereof open to said source of heat;

a plurality of tie rods secured to each of said horizontal plates and extending through some of the perforations in the end plates, means for securing said tie rods to said end plates, and to maintain the oven assembled.

6. A reflector oven as claimed in claim 5, including a plurality of spaced protuberances on the reflectors positioned to extend through at least some of the arcuately positioned perforations in the end plates not occupied by the tie rods.

7. A reflector oven as claimed in claim 5 wherein said end plates are substantially rectangular in shape with a flat bottom surface.

8. A reflector oven as claimed in claim 5 wherein said end plate protuberances are formed therein in positions to provide a plurality of elliptically shaped, abutting reflective plates.

9. A reflector oven as claimed in claim 5 wherein a grill includes locking means cooperating with end plates when the oven is assembled to form a stationary imperforate heat-reflecting surface.

10. A reflector oven as claimed in claim 5 wherein the locking members comprise curved edges at the ends of the longitudinal surfaces of the reflecting plates to interlock with each other and means for affording said interlock.

11. A reflector oven as claimed in claim 1 wherein the reflector plates are provided with tabs on two opposite edges thereof adapted to extend through at least some of the perforations in the end plates to assist in locking the assembly together.

12. A reflector oven as claimed in claim 5 wherein the parts thereof are formed by sheet metal.

13. A reflector oven as claimed in claim 5 wherein the reflective plates are formed of reflective metal on at least one side thereof.

14. A reflector oven as claimed in claim 5 wherein a fourth series of perforations is formed in a substantially horizontal configuration approximately halfway between the top and the bottom of the plates, and a cooking grill comprising a plurality of space horizontally aligned bars of sufficient length to extend through the fourth series of perforations to be supported by the end plates when the grill is assembled is provided.

15. A reflector oven as claimed in claim 14 wherein the opposite ends of the aligned adjacent bars are provided with means for assisting the oven being maintained in an assembled condition.

16. A reflector oven as claimed in claim 14 wherein the last means comprises ends on at least some of the bars which extend through the fourth series of perforations in both end plates and are bent at the sides to engage the outer surfaces of the end plates to retain the oven in an assembled position.

* * * * *